United States Patent [19]

Close

[11] 4,323,226

[45] Apr. 6, 1982

[54] CLAMP ASSEMBLY

[76] Inventor: Sam Close, R. R. #5, Box 312, Lebanon, Ind. 46052

[21] Appl. No.: 96,831

[22] Filed: Nov. 23, 1979

[51] Int. Cl.[3] ..... B25B 1/02

[52] U.S. Cl. ..... 269/208; 248/224.4

[58] Field of Search ..... 269/29, 41, 54.2, 238, 269/208, 207, 211, 279, 280, 283, 228, 246, 165; 248/503.1, 73, 224.4, 243

[56] References Cited

U.S. PATENT DOCUMENTS

| | | | |
|---|---|---|---|
| 193,951 | 8/1877 | Heckert | 269/208 X |
| 286,362 | 10/1883 | Wright | 269/208 X |
| 656,304 | 8/1900 | Sommer | 269/54.2 X |
| 1,163,145 | 12/1915 | Gross | 269/283 X |
| 1,393,083 | 10/1921 | Campbell | 269/283 X |
| 1,476,628 | 12/1923 | McDaniel et al. | 269/283 X |
| 1,479,209 | 1/1924 | Topp | 269/208 X |
| 1,517,309 | 12/1924 | Morgan | 269/165 X |
| 1,529,281 | 3/1925 | Taylor | 269/208 |
| 1,589,085 | 6/1926 | Anderson et al. | 269/280 X |
| 2,579,995 | 12/1951 | Atchison | 269/283 X |
| 2,651,959 | 9/1953 | Harrington | 269/208 |
| 2,714,755 | 8/1955 | Wright | 269/165 X |
| 3,147,002 | 9/1964 | Arnold | 269/29 X |
| 3,682,467 | 8/1972 | Heinrich | 269/41 X |
| 4,061,323 | 12/1977 | Beekenkamp | 269/208 X |
| 4,120,490 | 10/1978 | Carossina | 269/238 X |
| 4,146,140 | 3/1979 | Suter et al. | 248/243 |

FOREIGN PATENT DOCUMENTS

| | | | |
|---|---|---|---|
| 476953 | 5/1929 | Fed. Rep. of Germany | 269/283 |
| 735365 | 8/1955 | United Kingdom | 269/208 |
| 736120 | 8/1955 | United Kingdom | 269/208 |

*Primary Examiner*—Robert C. Watson

*Attorney, Agent, or Firm*—Jenkins, Coffey, Hyland, Badger & Conard

[57] ABSTRACT

A clamp assembly adaptable for retaining workpieces of various sizes and shapes includes an elongated metal bracket provided with a plurality of equally spaced perforations in parallel relationship to each other and two movable members for retaining the workpiece, having fingers for cooperating with the perforations to removably and interchangeably secure the retaining members to the bracket in one of a plurality of opposed spaced relationships. A portion of at least one of the retaining members is adjustable for engaging the workpiece and applying a sufficient force against the workpiece to retain it between the two members. The fingers of each retaining member engage perforations of the bracket in a manner such that the retaining members are locked into position in response to the force being applied to the workpiece by the engaging portion of the retaining members. The retaining members may be elevated by employing one or more elevating blocks which are removably secured to the bracket and to each other. The clamp assembly may also include two parallel brackets positioned in spaced parallel relationship to each other and retaining members having two sets of fingers for coincidentally engaging perforations in both of the brackets.

21 Claims, 16 Drawing Figures

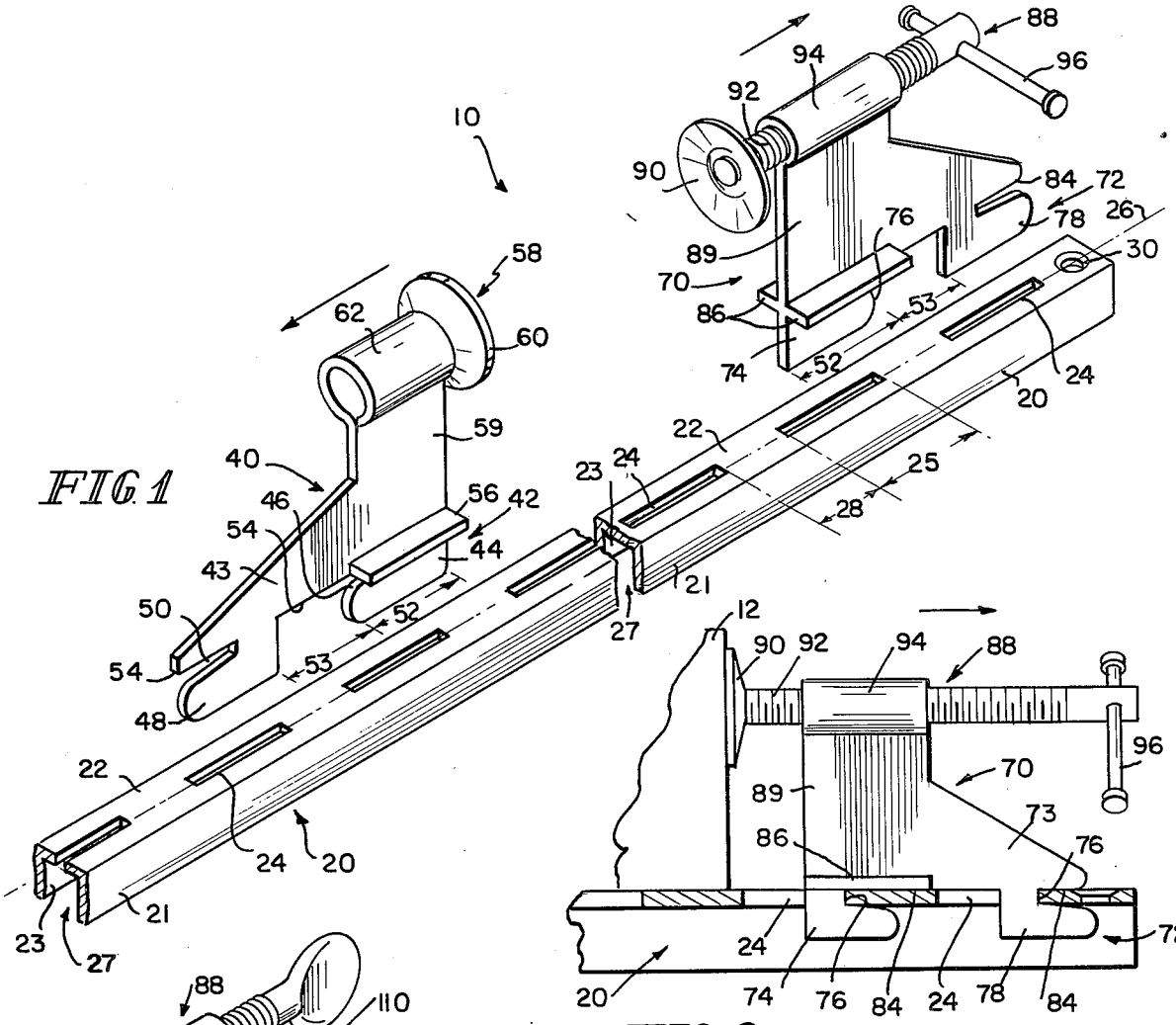
FIG. 1
FIG. 2
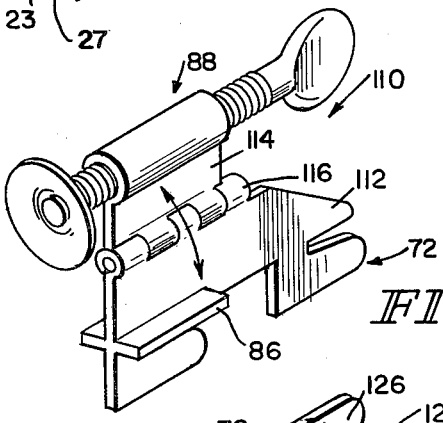
FIG. 4
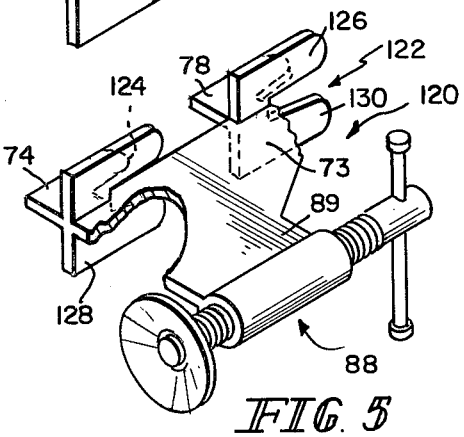
FIG. 5
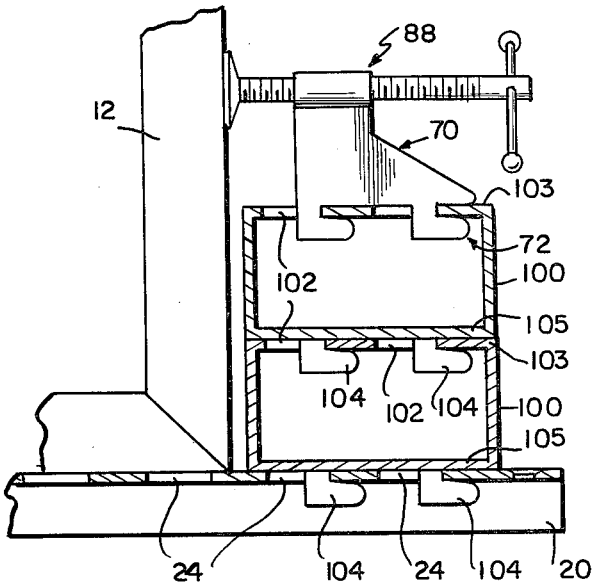
FIG. 3

CLAMP ASSEMBLY

The present invention is related to assemblies for clamping a workpiece and in particular to improvements in such a clamp assembly which gives the assembly a high degree of versatility.

There are many clamp assemblies known in the prior art. Each of these assemblies includes its own peculiar feature or features which makes its use advantageous for a particular purpose. Because of these individual features, it is many times necessary to use a different assembly for each job. For example, one clamp assembly may be advantageously used as a gluing clamp for clamping planar surfaces. However, the same assembly may not be adaptable for clamping irregular surfaces or for use where greater clamping forces are necessary. Furthermore, the size of the workpiece may necessitate the use of various sizes of individual clamps. Accordingly, the frequent user of clamp assemblies may need a repertoire of clamp assemblies of different sizes, shapes, and other features to assure that he has an available assembly to do the job.

These problems associated with conventional clamp assemblies are solved by the highly versatile clamp assembly of the present invention wherein the clamp assembly in a broad concept includes a perforated bracket and two members for retaining a workpiece therebetween having fingers which cooperate with the perforations of the bracket for removably and interchangeably securing the members to the bracket in one of a plurality of opposed spaced relationships to accommodate workpieces of various sizes and shapes.

One object of the present invention is to provide a clamp assembly wherein the members for retaining the workpiece are removable and interchangeable with other retaining members having different features so that the assembly can accommodate various shapes of workpieces and be used for a variety of purposes.

Another object of the present invention is to provide a clamp assembly wherein the retaining members are locked in the bracket in response to the forces being applied by the retaining members to the workpiece.

A further object of the present invention is to provide a clamp assembly as described hereinabove wherein the retaining members are movable and may be secured at one of a plurality of locations on the bracket to accommodate various sizes of workpieces. In this regard, elevating blocks are provided which may be stacked and secured to the bracket for positioning the retaining members in spaced relationship to the bracket.

Also provided in accordance with the present invention are means carried by at least one of the retaining members for adjustably engaging and applying a retaining force to a surface of the workpiece. In accordance with the present invention, various engaging means may be employed by interchanging and securing various retaining members to the bracket.

It can be appreciated that by providing a bracket and various retaining members carrying various means for engaging the surface of a workpiece in a single package, the user of a clamp assembly constructed in accordance with the present invention has the versatility to clamp various sizes and shapes of workpieces and to use the clamp assembly for a multitude of purposes.

While various objects of the present invention have been described hereinabove, other objects and advantages of the present invention will become apparent in the following detailed description of the invention, which description should be considered in conjunction with the accompanying drawings in which:

FIG. 1 is an exploded perspective view of a clamp assembly constructed in accordance with the present invention;

FIG. 2 is a partially sectioned side elevational view of a part of the assembly of FIG. 1;

FIG. 3 is a partially sectioned side elevational view of the part of the assembly of FIG. 2 illustrating a feature of the present invention;

FIG. 4 is a diagrammatic view of a retaining member of the assembly of FIG. 1 illustrating another embodiment thereof;

FIG. 5 is a diagrammatic view of a retaining member of the assembly of FIG. 1 illustrating another embodiment thereof;

Figure 7A:
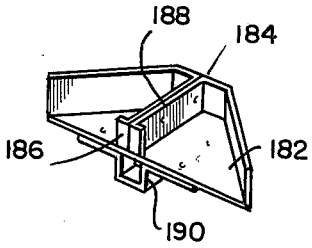
FIG. 7 is a top elevational view of a clamp assembly constructed in accordance with the present invention illustrating another embodiment of the retaining members.
Figure 7:
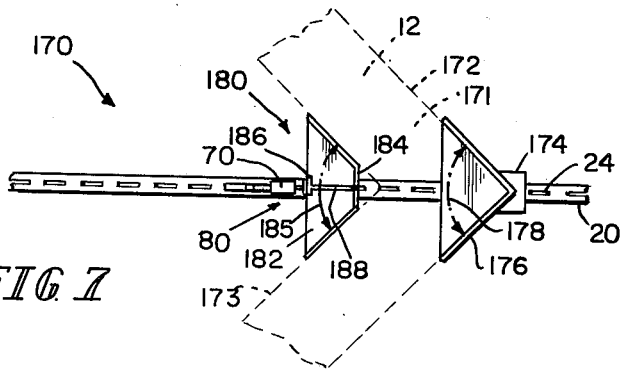
Figure 8:
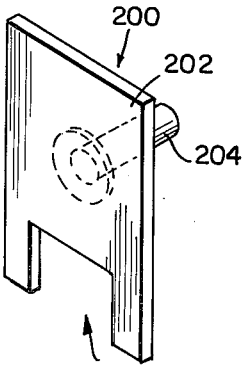
Figure 8A:
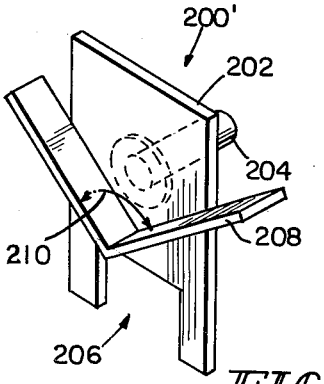
Figure 9:
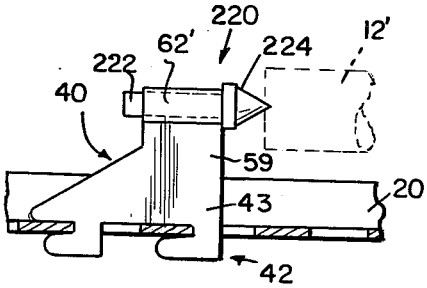
Figure 10:
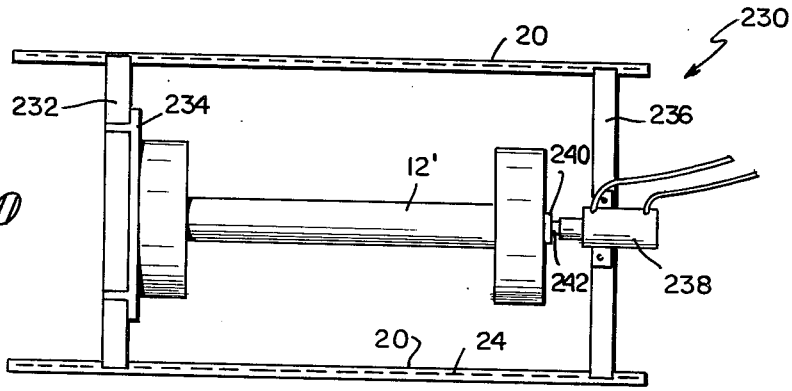
Figure 13:
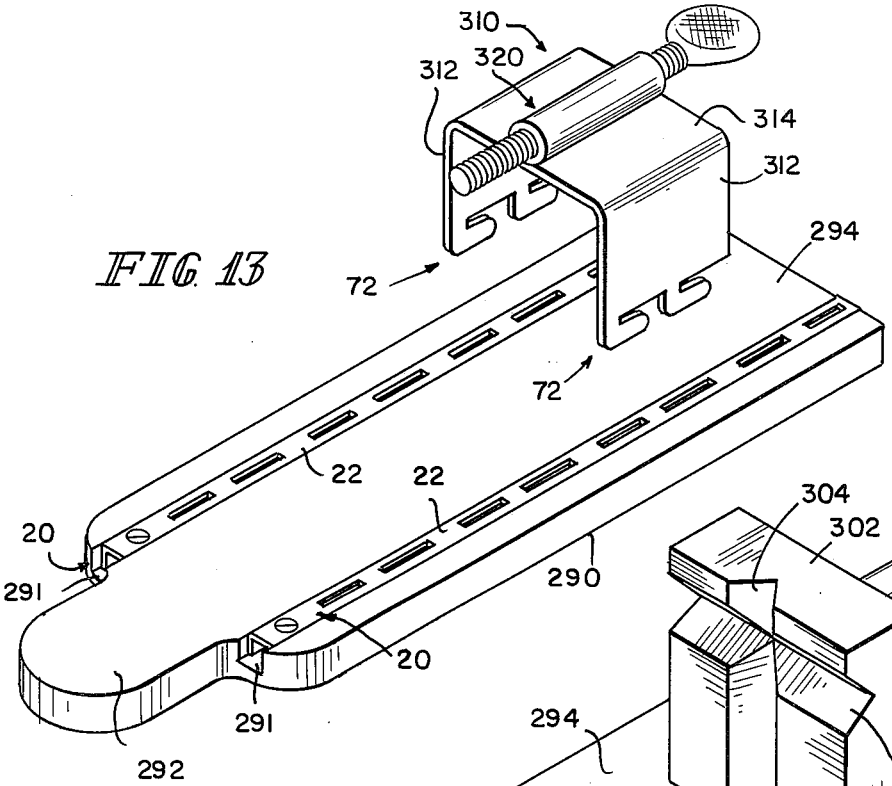
Figure 12:
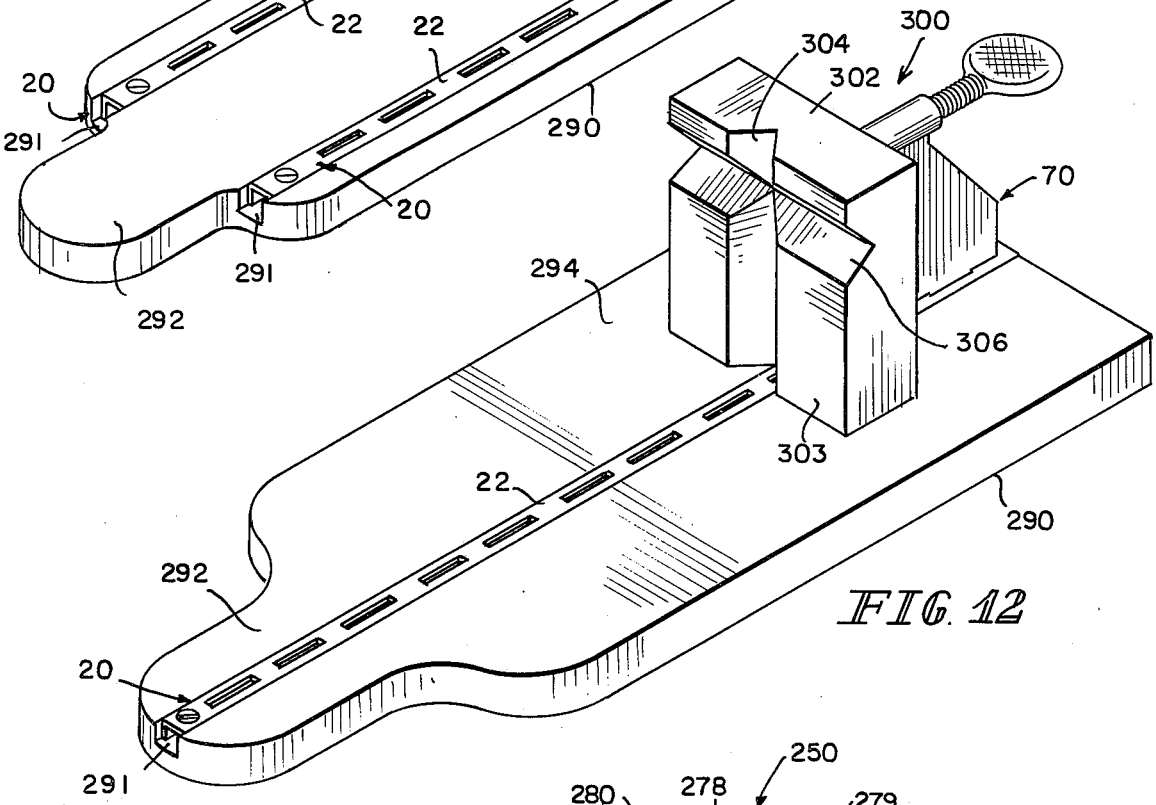
Figure 11:
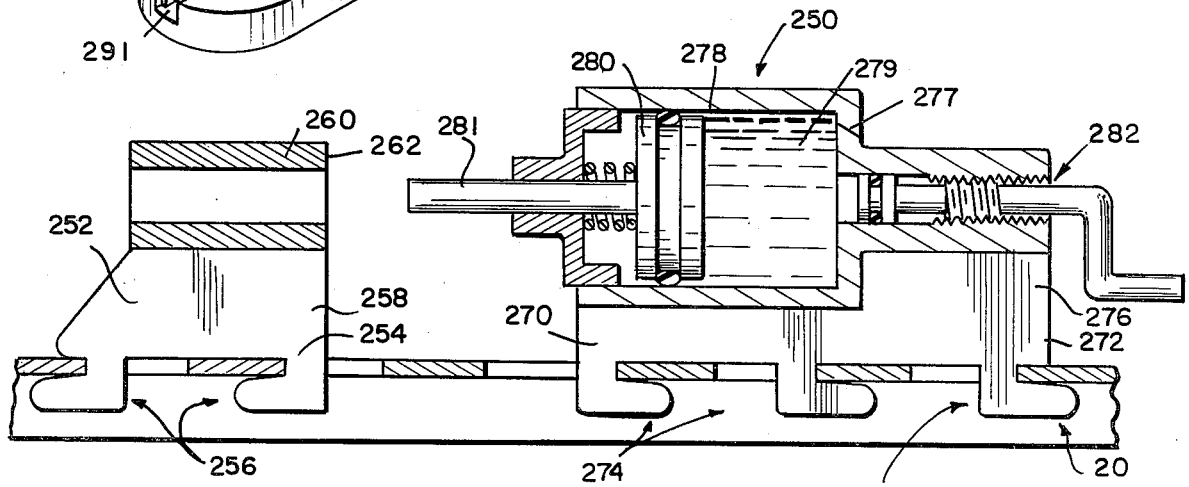
Figure 14:
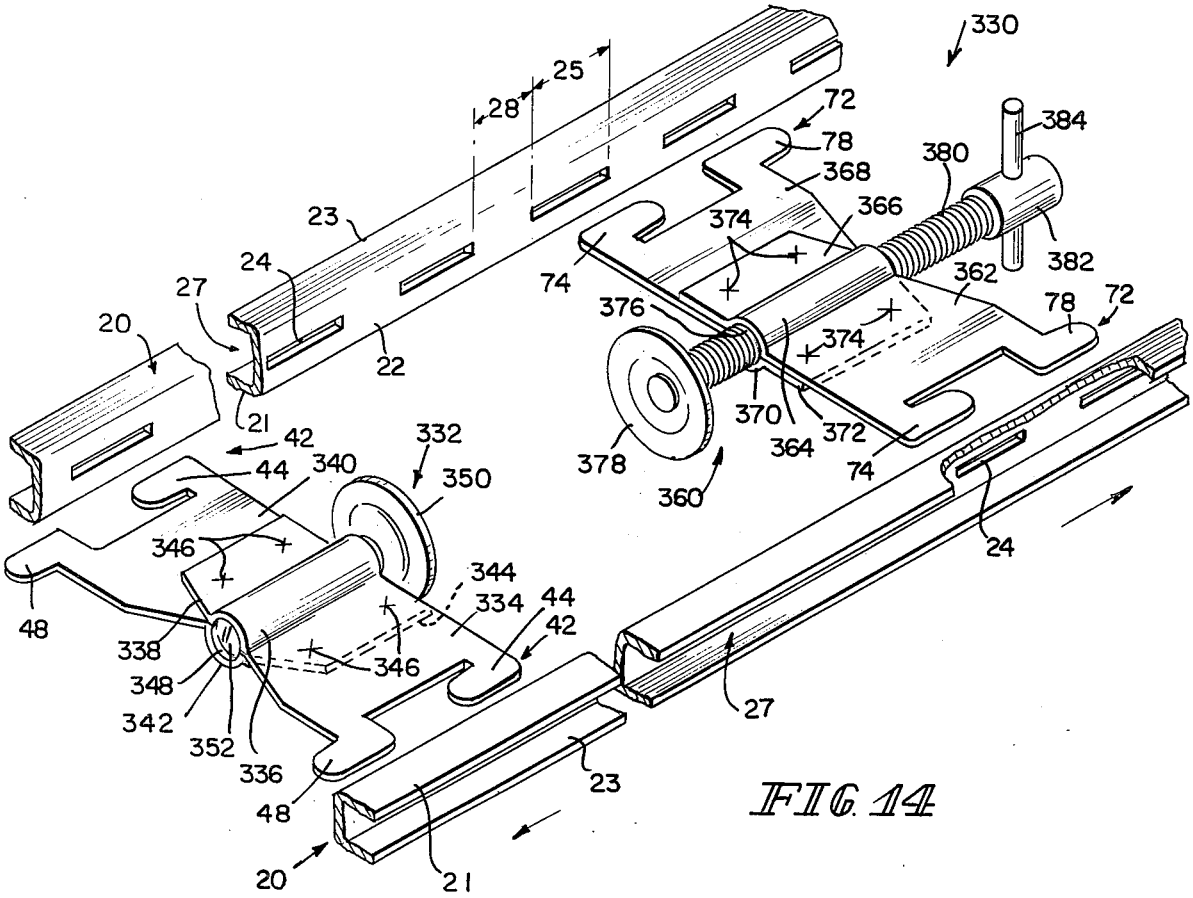

FIG. 7*a* is a detailed fragmentary view of the retaining members of the assembly of FIG. 7;

FIG. 8 is a diagrammatic view of a portion of a retaining member of the assembly of FIG. 1;

FIG. 8*a* is a diagrammatic view of the portion of the retaining member of FIG. 8 illustrating an additional feature thereof;

FIG. 9 is a partially sectioned side elevational view of another embodiment of a retaining member of the assembly of FIG. 1;

FIG. 10 is a top elevational view of a clamp assembly constructed in accordance with the present invention illustrating its versatility;

FIG. 11 is a cross-sectional view of additional embodiments of retaining members of a clamp assembly constructed in accordance with the present invention;

FIG. 12 is a perspective view of a clamp assembly constructed in accordance with the present invention illustrating another embodiment of a retaining member and the adaptation of the assemblies shown in FIGS. 1 and 7 for various uses;

FIG. 13 is a perspective view of a clamp assembly constructed in accordance with the present invention illustrating another embodiment of a retaining member and the adaptation of the assembly shown in FIG. 10 for various uses; and FIG. 14 is a perspective view of a clamp assembly constructed in accordance with the present invention, illustrating another embodiment of a retaining member.

Turning now to FIGS. 1 and 2, a clamp assembly 10 for retaining workpieces 12 of various sizes and shapes includes an elongated metal bracket 20 fabricated from sheet metal having an upper surface or web portion 22 joining side walls 21, 23 and numerous elongated rectangular perforations or slots 24 provided in parallel relationship to each other in the upper surface 22. Each elongated perforation 24 has a length 25, is equally spaced 28 from the other perforations 24, and is included in a single plane 26. Provided at the ends of the bracket are apertures 30 for mounting the bracket 20 to a supportive substrate. One unique feature of the clamp assembly 10 of the present invention is that the bracket 20 may be of the type commercially sold in most hardware stores for mounting bookshelves to a wall. As best illustrated in FIG. 1, the bracket 20 is U-shaped in the form of a channel and inverted so that the perforations 24 provided in the upper surface 22 of the bracket 20 are raised from any supportive surface to provide a space 27 beneath the surface 22 to secure members for retaining the workpiece 12 in a manner to be described later.

A first member 40 for retaining the workpiece 12 includes means 42 which cooperate with the perforations 24 of the bracket 20 for removably securing the retaining member 40 to the bracket 20. The securing means 42 are carried by a lower portion 43 of the retaining member 40 and include a forward finger 44 which extends downward from the lower portion 43 and curls to the rear of the retaining member 40 to form a groove 46. A rear finger 48 is likewise provided on the lower portion 43 of the retaining member 40 and forms a groove 50. As illustrated in FIG. 1, the fingers 44 and 48 are each provided in a single plane which is generally the same plane as that of the retaining member 40. Importantly, the length 52 of the fingers 44, 48 must be less than the length 25 of the perforations 24 and the space 53 between the fingers 44, 48 must be slightly greater than the space 28 between the perforations 24, so that the fingers 44, 48 are insertable into the perforations 24. By applying a force to the retaining member 40 in the direction of the arrow shown in FIG. 1, the grooves 46 and 50 in cooperation with a lower edge 54 of the retaining member 40 engage the upper surface and the perforations 24 of the bracket 20 to secure the retaining member 40 to the bracket 20. Provided on either side of the retaining member 40 along its lower edge 54 are two opposed flanges 56 which also engage and rest upon the upper surface 22 of the bracket 20 to stabilize the retaining member 40. These flanges 56 may be separately formed and attached to the retaining member 40 by conventional means, e.g., welding, or may be extruded from the material forming retaining member 40 in a single material movement or as coating step of the manufacturing process. It should be noted that the flanges 56 are generally perpendicular to the plane of the retaining member 40 and the fingers 44, 48.

Carried by the upper portion 59 of the retaining member 40 is a first means 58 for engaging a surface of the workpiece 12. In one embodiment of a retaining member 40, the surface-engaging means 58 includes a circular plate or pad 60 fixedly mounted to a cylindrical mounting base 62 carried by or formed in the upper portion 59 of the retaining member 40. Accordingly, once the retaining member 40 has been secured in a position on the bracket 20, the engaging means 58 of member 40 is fixed in relation to the bracket 20. As will become more apparent in a description of the use of the clamp assembly 10, the first retaining member 40 will be secured in a position on the bracket 20 and the space between the first retaining member 40 and a second retaining member 70 will be determined by the workpiece 12 to be retained therebetween.

The second member 70 for retaining the workpiece 12 will be positioned in one of a plurality of opposed spaced relationships to the first member 40 to accommodate for the size of the workpiece 12. However, it will also be noted that the first retaining member 40 may likewise be repositioned, if necessary, to accommodate the workpiece 12.

In a manner similar to the first retaining member 40, the second retaining member 70 includes means 72 which cooperate with the perforations 24 of the bracket 20 for removably securing the second retaining member 70 to the bracket 20. The securing means 72 are carried by a lower portion 73 of the second retaining member 70 and include a forward finger 74 which extends downward from the lower portion 73 and curls to the rear of the second retaining member 70 to form a groove 76. A rear finger 78 is likewise provided on the lower portion 73 of the retaining member 70 and forms a groove 80. Again, it should be noted that each of the fingers 74, 78 is contained in a single plane which is generally the same as that of the retaining member 70. The fingers 74, 78 will have a length 52 and a space 53 therebetween which are substantially the same as the length 52 and space 53 of the fingers 44, 48 of the first retaining member 40.

As best illustrated in FIG. 2, the fingers 74, 78 are insertable into two perforations 24 so that the lower edge 84 of the retaining member 70 engages the upper surface 22 of the bracket 20. In response to a force applied to the retaining member 20 in the direction of the arrow shown in FIGS. 1 and 2, the grooves 76, 80 in cooperation with the lower edge 84 of the retaining member 70 engage the upper surface 22 and the perforations 24 of the bracket 20 to secure the retaining member 70 in a position on the bracket 20. As further illustrated in FIG. 2, flanges 86 provided on either side of the retaining member 20 adjacent to the lower edge 84 also engage the upper surface 22 of the bracket 20 to provide stability to the retaining member 70. It will again be appreciated that flanges 86 may be separately formed and attached to the retaining member 70 by conventional means, e.g., welding, or may be extruded from the material forming retaining member 70 in a single material movement or as coating step of the manufacturing process.

While FIG. 2 illustrates the manner in which the second retaining member 70 is secured to the bracket 20, it will be understood that the first retaining member 40 is secured to the bracket 20 in a similar manner to that shown in FIG. 2. It should, however, be noted that the forces which lock the first and second retaining members 40, 70 in position on the bracket 20 are in opposite directions so that a force being applied by a first retaining member to the workpiece 12 provides the necessary force to lock the first retaining member 40 to the bracket 20 and a force applied by the second retaining member 70 to the workpiece 12 provides the opposing force to lock the second retaining member 70 to the bracket 20.

Continuing to refer to FIGS. 1 and 2, a second means 88 for engaging a surface of the workpiece 12 is carried by an upper portion 89 of the second retaining member 70. Again, in one embodiment of the second retaining member 70, the engaging means 88 includes a circular plate or pad 90 which is swivel-mounted to a shaft 92. The shaft 92 is threadably received by a cylindrical mounting base 94 carried by or formed in the upper portion 89 of the retaining member 70. Accordingly, by rotating the shaft 92 within the cylindrical mounting base 94, the shaft 92 is axially movable for adjustment to engage a surface of the workpiece 12. A handle portion 96 is provided on the shaft 92 to give the user of the clamp assembly 10 sufficient leverage with which to apply the necessary force to retain the workpiece 12 between the first and second members 40, 70.

In accordance with the description provided hereinabove, it can therefore be seen that the capabilities of the clamp assembly 10 to adapt to various sizes of the workpiece 12 need only be limited by the length of the bracket 20. This feature therefore gives the clamp assembly 10 a high degree of versatility with respect to accommodating various sizes of workpieces 12.

Various embodiments of retaining members and engaging means are described hereinafter. It will be appreciated that these various embodiments may be interchanged with either the first retaining member 40 or the second retaining member 70 or both illustrated in FIG. 1, without departing from the scope of the present invention. Furthermore, as the various embodiments of retaining members and engaging means are described, it should be pointed out that the same reference numerals are used to identify portions of the retaining member or engaging means which are the same as portions previously described in conjunction with earlier figures.

Referring now to FIG. 3, the clamp assembly 10 further includes one or more stackable rectangular hollow blocks 100 for elevating the retaining members 40, 70 to a desired height above the bracket 20 to retain a workpiece 12 having at least one long surface. Each elevating block 100 includes at least two elongated perforations 102 provided in one side 103 of the block 100. These perforations 103 have a shape and length generally equivalent to the perforations 24 formed in the bracket 20 so that they are capable of receiving the securing means 42, 72 of the retaining members 40 and 70. Furthermore, each elevating block 100 includes two fingers 104 formed in a side 105 opposed to the side 103 containing the perforations 102 to secure each block 100 to either the bracket 20 or to another block 100. The fingers 104 are generally of the same construction as the securing means 42, 72 provided on the retaining members 40, 70 and function in the same manner to secure the elevating blocks 100 to the bracket 20 or to each other.

Referring now to FIG. 4, one embodiment of a retaining member 110 which may be employed in the clamp assembly 10 illustrated in FIG. 1 includes a lower portion 112 provided with securing means 72 and an upper portion 114 carrying means 88 for engaging a surface of the workpiece 12. In the embodiment illustrated in FIG. 4, the upper portion 114 of the retaining member 110 is pivotally coupled to the lower portion 112 so that the upper portion 114 can be axially rotated to either side of the bracket 20, as indicated by the arrow. Accordingly, the engaging means 88 may be positioned at an angle to the plane of the lower portion 112 and the securing means 72 of the retaining members 110 to accommodate various shapes of workpieces 12.

Turning to FIG. 5, a retaining member 120 having a lower portion 73 and an upper portion 89 carrying an engaging means 88 includes means 122 for securing the retaining member 120 to the bracket 20. The securing means 122 includes a first set of forward and rear fingers 74, 78 each contained within the same plane as the retaining member 120. The securing means 122 also includes a second set of forward and rear fingers 124 and 126 provided on one side of the retaining member 120 generally perpendicular to the plane of the retaining member and the first set of fingers 74, 78, and further, a third set of forward and rear fingers 128, 130 provided on the other side of the retaining member 120 opposed to the second set of fingers 124, 126 and generally perpendicular to the plane of the retaining member 120 and first set of fingers 74, 78. Accordingly, the retaining member 120 may be secured to the bracket 20 in any one of three positions. The retaining member 120 may be positioned in the same plane 26 as the perforations 24 or perpendicular to such plane 26 on either side of the bracket 20 to accommodate workpieces 12 of various shapes. Importantly, the flanges 56, 86 described with respect to the retaining members 40, 70 shown in FIGS. 1 and 2 are no longer necessary, since the three sets of fingers and the lower portion 73 of the retaining member 120 provide the necessary surfaces for engaging the bracket 20 when the retaining member 120 is secured in any one of its three positions with respect to the bracket 20.

Figure 6:
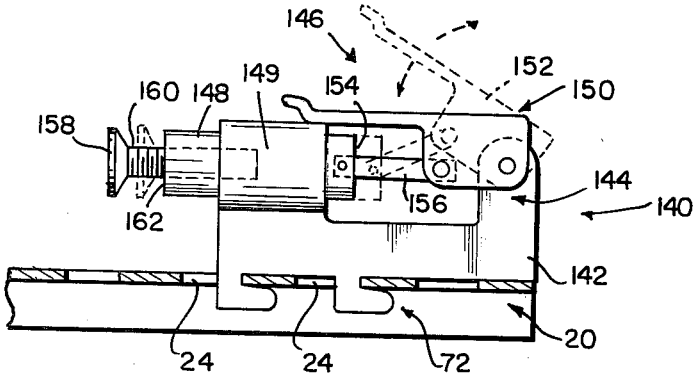
FIG. 6 is a side elevational view of a retaining member of the assembly of FIG. 1 illustrating another embodiment thereof.

Illustrated in FIG. 6 is one embodiment of a retaining member 140 which includes a lower portion 142 having means 72 for securing the retaining member 140 to the bracket 20 and a U-shaped upper portion 144 carrying a means 146 for engaging a surface of the workpiece 12 (not shown). The engaging means 146 includes a piston 148 slidably received by a cylinder 149 formed in the upper portion 144 of the retaining member 140. An over-center latch assembly 150 is coupled to the piston 148 and includes a handle 152 pivotally carried by the upper portion 144. The handle 152 of the latch assembly 150 is coupled to one side 154 of the piston 148 by a lever 156 so that in response to movement of the handle 152 in the direction of the arrows shown in FIG. 6, the piston is axially moved within the cylinder 149. As illustrated, the lever 156 is connected to the piston 148 and the handle 150 such that when the handle 152 is forced downward, the latch 150 locks the piston 148 in its fully extended position within the cylinder 149. A circular pad or plate 158 is swivel-mounted to a shaft 160 threadably received by the outer end 162 of the piston 148 so that in addition to the axial movement of the piston 148 within the cylinder 149 the engaging means 146 may be adjustably projected or retracted as necessary to accommodate a particular workpiece 12.

A clamp assembly 170 constructed in accordance with the present invention for retaining a corner 171 of a workpiece 12 is illustrated in FIG. 7. Secured to a bracket 20, in a manner previously described, is a first retaining member 174 including an angular plate 176 carried vertically by the first retaining member 174 for engaging an outside surface 172 of the corner 171. The angle 178 formed by the angular plate 176 may be any desired angle for accommodating various corners 171 of a workpiece 12 and in fact may be adjustable for accommodating corners of various workpieces 12. In one embodiment, the angle is 90°. Also secured to the bracket 20 in a manner previously described is a second retaining member 180 which includes the retaining member 70 shown in FIG. 1 and an anglular plate 182 slidable along the bracket 20 independent of the retaining member 70 for engaging an inside surface 173 of the corner 171. As illustrated in more detail in FIG. *7a*, the angular plate 182 includes a planar surface 184 provided at the apex of the angle 185 formed by the plate 182. The planar surface 184 allows the plate 182 to securely engage the inside surface 173 of the angle 171. The plate 182 also includes a planar surface 186 located to the rear of the plate 182 which is engaged by the engaging means 88 of the retaining member 70. A reinforcing brace 188 is provided between the planar surfaces 184, 186 located to the front and rear of the plate 182, respectively. The plate 182 further includes a rectangular channel 190 having a sufficient area to allow the passage of the bracket 20 therethrough so that the plate 182 is slidable along the bracket 20.

Referring to FIG. 8, one embodiment of an engaging means 200 which may be carried by one or more retaining members includes a rectangular plate 202 fixedly mounted to a shaft 204 which is insertable in a hollow cylindrical mounting base of similar construction to those shown in FIG. 1. The rectangular plate 202 includes a window or gate 206 for receiving the bracket 20 and providing stability to the plate 202. As an additional feature, a rectangular pad 200' constructed in the manner illustrated in FIG. 8 may also include an angular support 208 mounted perpendicular to the plane of the rectangular plate 202 for engaging angular surfaces of a workpiece 12. The angle 210 formed by the angular support 208 may be any desired angle for the intended use of the engaging means 200. It should be noted that the engaging means 200, 200' may be interchangeable with the plate or pad 60 shown in FIG. 1 by forming a hollow cylindrical supporting base 62 and mounting the plate 60 to a shaft insertable into the supporting base 62. In this manner, the first retaining member 40 is capable of carrying a variety of engaging means to accommodate various shapes and sizes of workpieces 12.

Referring now to FIG. 9, engaging means 220 is shown in conjunction with a retaining member 40 having securing means 42, a lower portion 43, and an upper portion 59 which includes a hollow cylindrical supporting base 62' of the type just described. A shaft 222 has a conical means 224 for engaging a cylindrical workpiece 12' formed on one end. Accordingly, the shaft 222 is insertable in the hollow cylindrical supporting base 62' and the engaging means 220 is removable and therefore interchangeable with other engaging means constructed in accordance with the present invention. Importantly, it should be noted that the bracket 20 is shown in an inverted position whereby the securing means 42 are insertable through the perforations 24 in a manner opposite to that described with respect to the previous Figures. This again illustrates the versatility of the clamp assembly 10 of the present invention.

A clamp assembly 230 constructed in accordance with the present invention is illustrated in FIG. 10 and includes two brackets 20 positioned in spaced parallel relationship with respect to each other. A first retaining member 232 includes means for securing (not shown) the retaining member 232 to both of the brackets 20 and a plate 234 mounted to its top surface for engaging a cylindrical workpiece 12'. A second retaining member 236 includes means for securing (not shown) it to both of the brackets 20 and a fluid motor 238 which is mounted to the top surface of the retaining member 236. A means 240 for engaging a surface of the workpiece 12' is coupled to a shaft 242 which in a manner previously described is adjustably carried by the fluid motor 238. The clamp assembly 230 may be a seal or bearing press or an arbor press similar to that shown in FIG. 11.

Referring now to FIG. 11, a clamp assembly 250 includes a first retaining member 252 having a lower portion 254 with means 256 for securing the first retaining member 252 to a bracket 20. The first retaining member 252 also includes an upper portion 258 having a hollow cylindrical means 260 provided for engaging a surface of a workpiece 12 (not shown). The cylindrical engaging means 260 includes a surface 262 which engages the workpiece 12. A second retaining member 270 includes a lower portion 272 with means 274 for securing the second retaining member 270 to the bracket 20. As illustrated in FIG. 11, the securing means 274 includes three fingers constructed in a manner similar to those described previously in FIGS. 1 and 2. Accordingly, it is possible that the securing means of one or more of the retaining members of the present invention may include one or more fingers for securing the retaining member to the bracket 20. The second retaining member 270 also includes an upper portion 276 forming a fluid-controlled piston and cylinder mechanism 250 which includes a cylinder 278, a fluid 279 contained within the cylinder, and a piston 280 having axial movement imparted thereto in response to compression of the fluid 279. A shaft 281 is coupled to the piston 280 and is aligned so as to be receivable by the hollow cylinder 260 of the first retaining member 252. A crank assembly 282 is provided for imparting axial movement to the shaft 281 by compressing the fluid 279 contained within the cylinder 278 so that the shaft 281 is projected into the hollow cylinder 260. Accordingly, a workpiece 12 (not shown) may be aligned with the shaft 281 and the hollow cylinder 260 so that a portion of the workpiece is pressed into the cylinder 260 in response to the turning of the crank assembly 282.

Referring now in combination to FIGS. 12 and 13, the bracket 20 described hereinabove may be mounted to a supportive substrate 290 in a recess 291. The substrate 290 may include a portion 292 for facilitating the handling of the clamp assembly of the present invention so that the assembly may be either hand-held or clamped in a vise. By mounting the brackets 20 in the recess 291, the upper surface 22 of the bracket 20 is contained within the same plane as the upper surface 294 of the supportive substrate 290 so that a retaining member secured to the bracket 20 is stabilized by engaging and resting on the top surface 294 of the supportive substrate 290.

Referring particularly to FIG. 12, there is illustrated one embodiment of a retaining member 300 which may be advantageously used with a drill, drill press, or saw. The retaining member 300 includes the retaining member 70 described and illustrated in FIG. 1 and a block 302 constructed of wood or metal which is adjustably positioned to engage a workpiece 12. As described, the block 303 also engages the top surface 294 of the supportive substrate 290 to provide stability thereto. The block has a vertical V-shaped groove 304 intersecting a horizontal V-shaped groove 306 formed in a face 303 engaging a surface of a workpiece 12.

Referring particularly to FIG. 13, another retaining member 310 for use with two brackets 20 positioned in spaced parallel relationship to each other, as illustrated in FIG. 13, includes two vertical side panels 312, each provided with means 72 for securing the retaining member to the two brackets 20. A cross brace 314 connects the two side panels 312 to form the retaining member 310. Carried by the cross brace 314 is a means 320 for engaging a surface of the workpiece 12 (not shown) constructed in a manner similar to that previously described.

Turning now to FIG. 14, there is illustrated a further embodiment of a clamp assembly 330 constructed in accordance with the present invention. As in the embodiments previously illustrated and described in FIGS. 10 and 13, clamp assembly 330 includes two of the elongated metal brackets 20, each turned on a side wall 21, 23 so that their upper surfaces or web portions 22 and elongated perforations or slots 24 are facing each other in an opposed parallel relationship. Each elongated perforation 24 has a length 25 and is equally spaced 28 from the other perforations 24.

In the clamp assembly 330, a first member 332 for retaining the workpiece 12 includes two opposed sets of means 42, constructed in a manner previously described, which coincidentally cooperate with the perforations 24 of the opposed brackets 20 for removably securing the retaining member 332 to the brackets 20. Each of the securing means 42 includes a forward finger 44 and a rear finger 48 which are all provided in a single plane which is generally the same plane as that of the retaining member 332. As best illustrated in FIG. 14, each pair of fingers 44, 48 is insertable into the perforations 24 of one of the two brackets 20 so that by applying a force to the retaining member 332 in the direction of the arrow, the fingers 44, 48, in cooperation with the perforations 24, secure the retaining member 332 between the two brackets 20.

In one embodiment, the retaining member 332 includes two halves 334, 340, each structurally similar to the retaining member 40 previously shown and described in FIG. 1. Each half 334, 340 has provided at its distal end a pair of fingers 44, 48 as described above for securing the retaining member 332 to the brackets 20. As further illustrated, a first half 334 includes an upwardly extruded semicylindrical portion 336 and a flange 338, and a second half 340 includes a downwardly extruded semicylindrical portion 342 and a flange 344. The two halves 334, 340 are overlapped and mated so that they are attached to each other at points 346 by conventional means, such as, for example, welding, tacking, etc., and the two semicylindrical portions 336, 342 form a cylindrical mounting base 348 for carrying a first means 350 for engaging a surface of the workpiece 12. While one method of constructing the retaining member 332 has been shown and described, it will be understood that there are various other ways the retaining member 332 may be constructed, such as, for example, casting the retaining member 332 as a single piece.

In one embodiment of the retaining member 332, the surface-engaging means 350 includes a circular plate or pad carried by a shaft 352 which is slidably received by the cylindrical mounting base 348. It should be noted that the surface-engaging means 350 may be either fixedly or rotatably carried by the shaft 352.

A second member 360 for retaining the workpiece 12 will be positioned in one of a plurality of opposed spaced relationships to the first member 332 to accommodate for the size of the workpiece 12. Of course, the first retaining member 332 may likewise be repositioned, if necessary, to accommodate the workpiece 12.

The second retaining member 360 also includes two opposed sets of means 72, constructed in a manner previously described, which coincidentally cooperate with the perforations 24 of the opposed brackets 20 for removably securing the second retaining member 360 to the brackets 20. Each of the securing means 72 includes a forward finger 74 and a rear finger 78 which are all provided in a single plane which is generally the same plane as that of the retaining member 360. As best illustrated in FIG. 14, each pair of fingers 74, 78 is insertable into the perforations 24 of one of the two brackets 20 so that by applying a force to the retaining member 360 in the direction of the arrow, the fingers 74, 78, in cooperation with the perforations 24, secure the retaining member 360 between the two brackets 20.

In one embodiment, the second retaining member 360 also includes two halves 362, 368, each structurally similar to the retaining members 70 previously shown and described in FIG. 1 and identical to the halves 334, 340 of the first retaining member 332. Each half 362, 368 has provided at its distal end a pair of fingers 74, 78 as described above for securing the retaining member 360 to brackets 20. As further illustrated, a first half 362 includes an upwardly extruded semicylindrical portion 364 and a flange 366, and a second half 368 includes a downwardly extruded semicylindrical portion 370 and a flange 372. The two halves 362, 368 are overlapped and mated so that they are attached to each other at points 374 by conventional means such as, for example, welding, tacking, etc., and the two semicylindrical portions 364, 370 form a cylindrical mounting base 376 for carrying a second means 378 for engaging a surface of the workpiece 12. Again, it should be noted that the present invention is not intended to be limited to the manner of construction of retaining member 360 as just described, since there are various other ways the retaining member 360 could be constructed without departing from the scope of the invention.

In one embodiment of the retaining member 360, the surface-engaging means 378 includes a circular plate or pad which is swivel-mounted to a threaded shaft 380. The shaft 380 is threadably received by the cylindrical mounting base 376 and includes an apertured end portion 382 for receiving a handle 384. Accordingly, by rotating the shaft 380 within the cylindrical mounting base 376, the shaft 380 is axially movable for adjustment to engage a surface of the workpiece 12. The handle 384 provides the user of the clamp assembly 330 sufficient leverage with which to apply the necessary force to retain the workpiece 12 between the first and second members 332, 360.

What is claimed is:

1. An assembly for clamping a workpiece comprising a bracket including a plurality of equally spaced perforations in parallel relationship to each other and two workpiece-retaining members, each retaining member including means cooperating with the perforations for removably securing the members to the bracket in one of a plurality of spaced relationships, the securing means of each retaining member including first and second fingers provided in a single plane and spaced apart in a relationship corresponding to the spaced relationship of the perforations, and two additional fingers, the two additional fingers being provided generally perpendicular to the plane of the first and second fingers on one side of the retaining members and being spaced apart in a relationship corresponding to the spaced relationship of the perforations to allow the retaining member to be secured generally perpendicular to the plane of the perforations of the bracket.

2. An assembly for clamping a workpiece comprising a bracket including a plurality of equally spaced perforations in parallel relationship to each other and two workpiece-retaining members, each retaining member including means cooperating with the perforations for removably securing the members to the bracket in one of a plurality of spaced relationships, the securing means of each retaining member including first and second fingers provided in a single plane and spaced apart in a relationship corresponding to the spaced relationship of the perforations, and four additional fingers, two of the additional fingers being provided on one side of the retaining member generally perpendicular to the plane of the first and second fingers and being spaced apart in a relationship corresponding to the spaced relationship of the perforations, the other two additional fingers being provided on an opposed side of the retaining member generally perpendicular to the plane of the first and second fingers and also being spaced apart in a relationship corresponding to the spaced relationship of the perforations, whereby the retaining member can be secured generally perpendicular to the plane of the perforations on either side of the bracket.

3. An assembly for clamping a workpiece comprising a bracket including a plurality of equally spaced rectangular perforations in parallel relationship to each other and two workpiece-retaining members, each retaining member including means cooperating with the perforations for removably and bidirectionally securing the members to the bracket in one of a plurality of self-aligned and opposed spaced relationships, a first retaining member including first means fixedly mounted thereto for engaging the workpiece, a second retaining member including a piston and cylinder mechanism, a shaft threadably carried by the piston, and second means fixedly mounted to the shaft for engaging the workpiece, the shaft being axially adjustable relative to the piston and the piston being axially movable for engaging and applying a force to retain the workpiece between the first and second engaging means, the securing means providing means for locking the retaining members to the bracket to sustain them in a spaced relationship.

4. The assembly as recited in claim 3 wherein one of the engaging means includes a hollow cylinder formed in a first retaining member and another engaging means includes a shaft carried by a second retaining member, the shaft being adjustably movable for axial movement to engage the hollow cylinder.

5. The assembly as recited in claim 3 wherein the second retaining member further includes an over-center latch assembly coupled to the piston for applying a force to move the piston to clamp the workpiece between the two engaging means.

6. The assembly as recited in claim 3 wherein the second retaining member further includes a fluid means for applying a force to move the piston to clamp the workpiece between the two engaging means.

7. An assembly for clamping a workpiece comprising a bracket including a plurality of equally spaced rectangular perforations in parallel relationship to each other and two workpiece-retaining members, each retaining member including means for engaging the workpiece and means cooperating with the perforations for removably and bidirectionally securing the members to the bracket in one of a plurality of self-aligned and opposed spaced relationships corresponding generally to the size and shape of the workpiece, at least one of the retaining members including means for pivotally mounting the engaging means thereto so that the engaging means is pivotal to at least one side relative to the axis of the bracket, the securing means providing means for locking the retaining members to the bracket to sustain them in the spaced relationship.

8. The assembly as recited in claim 7 wherein the engaging means includes two plates fixedly and adjustably mounted to a first and second retaining member, respectively.

9. The assembly as recited in claim 8 wherein the plates are circular, one being rotatably mounted to the first retaining member and the other being rotatably mounted to a shaft carried by the second retaining member.

10. The assembly as recited in claim 7 wherein at least one of the retaining members includes an engaging means having a conical end for engaging the workpiece.

11. The assembly as recited in claim 7 wherein the fingers are provided in parallel relationship and spaced generally in a relationship corresponding to the spaced relationship of the perforations to self-align the retaining members in opposed relationship.

12. The assembly as recited in claim 11 wherein the perforations are provided generally in a single plane and the fingers are provided generally in a single plane for engagement with the perforations, the planes of the perforations and the fingers being generally the same when the retaining members are secured to the bracket.

13. The assembly as recited in claim 12 wherein each retaining member further includes two opposed flanges provided generally perpendicular to the plane of the fingers for engaging the upper surface of the bracket to provide stability to each retaining member.

14. The assembly as recited in claim 7 wherein one engaging means is fixedly mounted to a first retaining member and another engaging means is fixedly mounted to a shaft carried by a second retaining member, the shaft being adjustably movable for engaging and applying a force to retain the workpiece between the two engaging means.

15. The assembly as recited in claim 14 wherein the shaft is threadably carried by the second retaining member for axial movement.

16. An assembly for clamping a workpiece comprising a bracket including a plurality of equally spaced rectangular perforations in parallel relationship to each other and two workpiece-retaining members, each retaining member including means for engaging the workpiece and means cooperating with the perforations for removably and bidirectionally securing the members to the bracket in one of a plurality of self-aligned and opposed spaced relationships corresponding generally to the size and shape of the workpiece, the engaging means including a first plate fixedly mounted to a first retaining member and a second plate adjustably mounted to a second retaining member, at least one of the plates being generally rectangular in shape and including a window for receiving the bracket, the securing means providing means for locking the retaining members to the bracket to sustain them in the spaced relationship.

17. The assembly as recited in claim 16 wherein the rectangular plate includes an angular member for supporting a sharp corner of the workpiece.

18. An assembly for clamping a workpiece comprising a bracket including a plurality of equally spaced rectangular perforations in parallel relationship to each other, first and second workpiece-retaining members, each retaining member including means cooperating with the perforations for removably and bidirectionally securing the members to the bracket in one of a plurality of self-aligned and opposed spaced relationships corresponding generally to the size and shape of the workpiece, the securing means providing means for locking the retaining members to the bracket to sustain them in the spaced relationship, a first vertical angular means fixedly mounted to the first retaining member for engaging an outside surface of a corner of the workpiece, a second vertical angular means for engaging an inside surface of the corner of the workpiece, a shaft adjustably carried by the second retaining member and a plate fixedly mounted to the shaft for engaging and adjustably applying a force to the second vertical angular means to retain the workpiece between the two vertical angular means.

19. The assembly as recited in claim 18 wherein the second angular means includes a channel for receiving the bracket, thereby guiding its movement.

20. An assembly for clamping a workpiece comprising a bracket including a plurality of equally spaced rectangular perforations in parallel relationship to each other and two workpiece-retaining members, each retaining member including means for engaging the workpiece and means cooperating with the perforations for removably and bidirectionally securing the members to the bracket in one of a plurality of self-aligned and opposed spaced relationships corresponding generally to the size and shape of the workpiece, and stackable means for elevating the retaining members, each elevating means including at least two rectangular perforations and means cooperating with the perforations of the bracket and the elevating means for removably and bidirectionally securing the elevating means to the bracket and to other elevating means secured to the bracket, the securing means providing means for locking the retaining members to the elevating means and the elevating means to each other and to the bracket.

21. The assembly as recited in claim 20 wherein the bracket is mounted to a supportive substrate and the substrate includes a portion for facilitating the handling of the assembly by the user.

* * * * *